US008480216B2

(12) United States Patent
Matsumoto et al.

(10) Patent No.: US 8,480,216 B2
(45) Date of Patent: Jul. 9, 2013

(54) LIQUID EJECTING APPARATUS

(75) Inventors: Hitoshi Matsumoto, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 11 days.

(21) Appl. No.: 13/355,882

(22) Filed: Jan. 23, 2012

(65) Prior Publication Data

US 2012/0194620 A1 Aug. 2, 2012

(30) Foreign Application Priority Data

Jan. 31, 2011 (JP) ..... 2011-017641

(51) Int. Cl.
*B41J 2/175* (2006.01)

(52) U.S. Cl.
USPC ..... 347/85

(58) Field of Classification Search
USPC ..... 347/84, 85, 86
See application file for complete search history.

(56) References Cited

U.S. PATENT DOCUMENTS

| | | | | |
|---|---|---|---|---|
| 6,540,341 | B2 * | 4/2003 | Hsieh et al. | 347/86 |
| 6,908,180 | B2 * | 6/2005 | Dietl | 347/85 |
| 7,278,718 | B2 * | 10/2007 | Aruga et al. | 347/85 |
| 7,556,362 | B2 * | 7/2009 | Akahane | 347/86 |
| 7,699,450 | B2 * | 4/2010 | Furukawa et al. | 347/85 |
| 2003/0146958 | A1 | 8/2003 | Aruga et al. | |
| 2005/0231563 | A1 | 10/2005 | Fujishiro et al. | |

FOREIGN PATENT DOCUMENTS

| | | |
|---|---|---|
| JP | 05-261934 | 10/1993 |
| JP | 2005-193570 | 7/2005 |
| JP | 2007-015409 | 1/2007 |

* cited by examiner

*Primary Examiner* — Anh T. N. Vo
(74) *Attorney, Agent, or Firm* — Workman Nydegger

(57) ABSTRACT

A liquid ejecting apparatus includes a pressure control unit provided in a liquid flow path so as to control pressure. The pressure control unit includes a liquid introduction unit, a liquid chamber having a diaphragm, a communication hole that allows communication between the liquid introduction unit and the liquid chamber, a movable member including an opposing surface disposed on the side of the liquid chamber so as to oppose the communication hole, the movable member being disposed so as to move in response to the displacement of the diaphragm unit, and a displacement member that displaces the opposing surface between a first posture of opposing the communication hole and a second posture in which the opposing surface is tilted with respect to the communication hole in an angle different from the first posture.

8 Claims, 5 Drawing Sheets

LIQUID EJECTING APPARATUS

BACKGROUND

This application claims priority to Japanese Patent Application No. 2011-017641, filed Jan. 31, 2011 and which is expressly incorporated herein by reference.

1. Technical Field

The present invention relates to a liquid ejecting apparatus.

2. Related Art

For example, JP-A-2007-15409 and JP-A-5-261934 disclose an ink jet printer as an exemplary form of a liquid ejecting apparatus.

The ink jet printer according to JP-A-2007-15409 includes a mechanism that displaces a pressure receiver of a self-closing valve, serving to control ink supply pressure to a liquid ejecting head, by applying an external force with a cam to the pressure receiver, to thereby discharge bubbles from the pressure chamber of the self-closing valve.

In the printer according to JP-A-5-261934, ink is supplied to the ink chamber through a second ink tank, a first ink tank, and a reservoir. The second ink tank includes a mechanism that stirs the ink by driving a motor so as to rotate a propeller, and an ink pressure controller is provided between the first ink tank and the second ink tank.

In the foregoing printers, it is essential to constantly stabilize the ink ejecting condition and performance, in order to maintain high printing quality. Accordingly, a pressure control unit such as a pressure-regulating valve or a damper that stores the ink so as to control the pressure thereof is provided in the ink flow path connecting between the ink cartridge and the ink jet head. Such a pressure control unit inevitably delays the flow of the ink owing to its required function, which leads to a disadvantage in that, in the case where a pigment dispersion ink is employed, ingredients of the solvent are prone to deposit in the ink flow path.

Although the mechanism according to JP-A-2007-15409 that displaces the pressure receiver of the self-closing valve by applying an external force with the cam to the pressure receiver can be expected to stir up the deposited ingredients when discharging the bubbles, the mechanism requires a complicated structure.

Likewise, the mechanism according to JP-A-5-261934 that stirs the ink by driving the motor so as to rotate the propeller also requires a complicated structure. In addition, a space for stirring the ink in which at least the propeller can be placed is necessary in order to incorporate such a stirring mechanism, which leads to an increase in size of the printer.

SUMMARY

An advantage of some aspects of the invention is that a liquid ejecting apparatus is provided that can stir up ingredients of the liquid deposited in a pressure control unit without employing a complicated mechanism.

In an aspect, the invention provides a liquid ejecting apparatus including a pressure control unit provided in a liquid flow path connecting between a liquid reservoir and a liquid ejecting head, and configured to store the liquid and control a pressure thereof, wherein the pressure control unit includes: a liquid introduction unit having a liquid inlet communicating with the liquid reservoir; a liquid chamber including a liquid outlet communicating with the side of the liquid ejecting head and a diaphragm to be displaced in accordance with a pressure; a communication hole that allows communication between the liquid introduction unit and the liquid chamber; a movable member including an opposing surface disposed on the side of the liquid chamber so as to oppose the communication hole, the movable member being disposed so as to move in response to the displacement of the diaphragm unit; and a displacement member that displaces, in accordance with a pressure of the liquid chamber, the opposing surface between a first posture of opposing the communication hole and a second posture in which the opposing surface is tilted with respect to the communication hole in an angle different from the first posture.

In the thus-configured liquid ejecting apparatus, the opposing surface of the movable member, disposed so as to move in response to the displacement of the diaphragm unit of the pressure control unit, is displaced between the first posture and the second posture in accordance with the pressure of the liquid chamber. Accordingly, the flow of the liquid introduced from the liquid introduction unit into the liquid chamber through the communication hole can be changed by the tilting action of the opposing surface, so that such change in the liquid flow stirs up the deposited ingredients of the liquid.

The liquid ejecting apparatus may further include a suction unit that sucks the liquid from the liquid ejecting head, and the opposing surface may be displaced to the second posture when the pressure reaches a predetermined level by a sucking operation of the suction unit.

With such a configuration, the opposing surface is tilted when a cleaning operation is performed in which the liquid is forcibly sucked from the liquid ejecting head, so that the flow of the liquid introduced through the communication hole is changed. Such an arrangement allows the opposing surface to remain in the first posture during a normal operation in which the ink is ejected from the liquid ejecting head, thereby preventing the pressure control function from being affected by the tilting action of the opposing surface.

In the foregoing liquid ejecting apparatus, the displacement member may be formed so as to project in a direction in which the diaphragm unit is displaced, and located at a position different from the center of gravity of the movable member.

Such a configuration allows the displacement member to apply a momentum about the position of the center of gravity thereof to the movable member in response to the displacement of the diaphragm unit, to thereby tilt the opposing surface.

Further, the opposing surface may be disposed so as to be tilted in the second posture such that a lower portion thereof is positioned farther away from a surface where the communication hole is located than an upper portion of the opposing surface opposite the lower portion across the communication hole.

In this case, when the opposing surface is in the second posture, the flow of the liquid introduced through the communication hole is conducted toward the lower portion which is farther away from the surface where the communication hole is located, so that the ingredients deposited on the lower side can be stirred up.

Further, the displacement member may include an annular portion projecting from the opposing surface so as to block all directions other than a direction in which the opposing surface is tilted in the second posture.

Such a configuration restricts the liquid that has been introduced through the communication hole and has collided against the opposing surface from flowing in directions other than the direction in which the opposing surface is tilted, to thereby cause the liquid to flow with greater force in the direction in which the opposing surface is tilted, thus more efficiently stirring up the deposited ingredients of the liquid.

Further, the displacement member may be provided on the movable member.

Providing the displacement member on the movable member, which moves in response to the displacement of the diaphragm unit, allows the displacement member to be displaced following up the tilting action of the opposing surface, thereby facilitating the bubbles to be discharged, even though the displacement member has a shape that is prone to detain or collect bubbles.

Still further, the liquid outlet may be located at a position upper than a bottom portion of the liquid chamber.

Such a configuration restricts the deposited ingredients accumulated on the bottom portion of the liquid chamber from being supplied to the liquid ejecting head through the liquid outlet, during the normal operation in which the ink is ejected from the liquid ejecting head.

Still further, the liquid outlet may be located at a position outside a region opposing the movable member when viewed in a direction in which the diaphragm unit is displaced.

In this case, a larger change in capacity takes place because of the displacement of the diaphragm unit outside the region opposing the movable member when viewed in a direction in which the diaphragm unit is displaced, and therefore locating the liquid outlet outside that region facilitates the bubbles to be effectively discharged through the liquid outlet.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
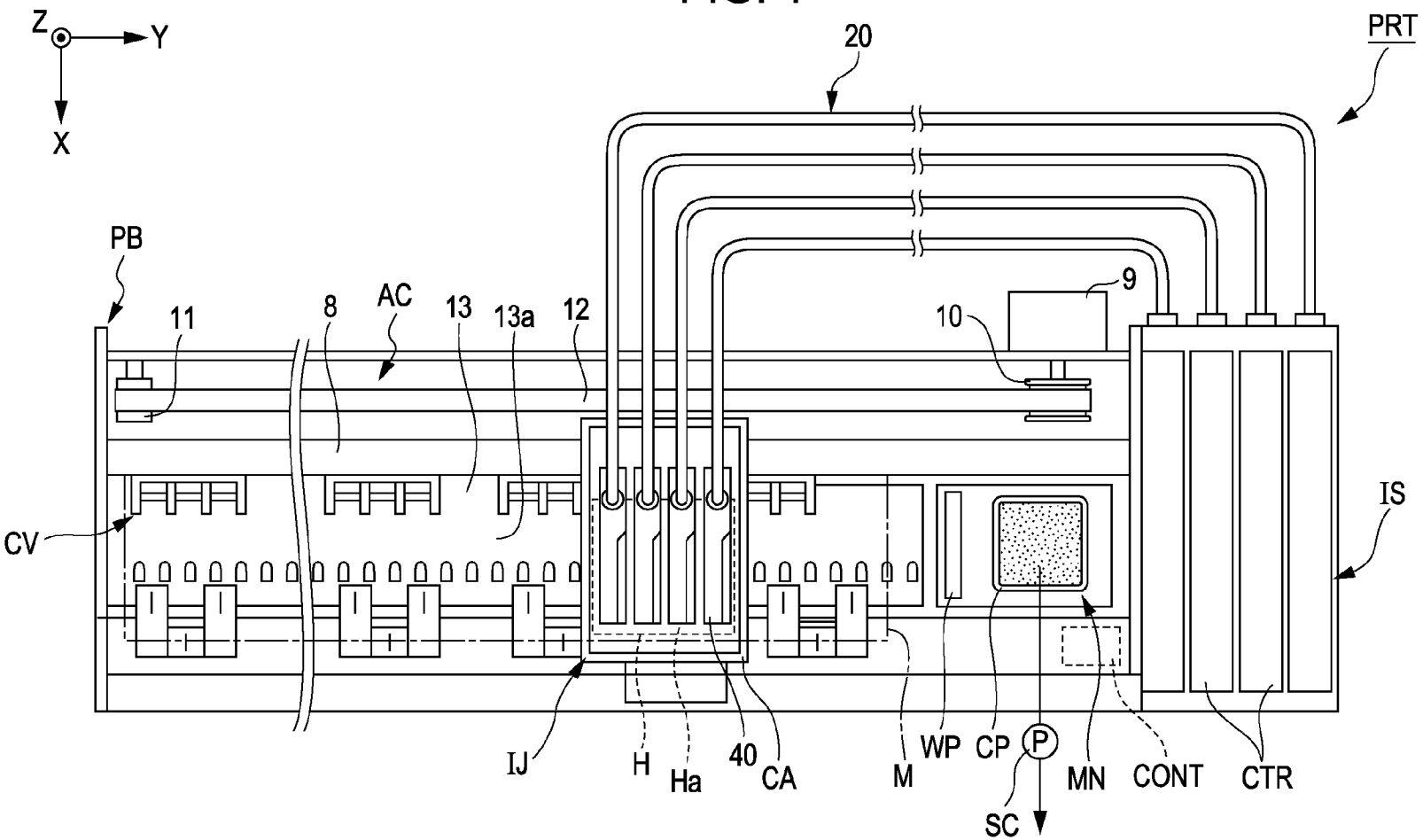
FIG. 1 is a schematic plan view of a printer according to an embodiment of the invention.

Hereafter, embodiments of a liquid ejecting apparatus according to the invention will be described referring to the drawings. In the drawings hereafter referred to, the scale of the constituents may be adjusted for the sake of clarity of the description. In the following embodiments, the liquid ejecting apparatus according to the invention will be exemplified by an ink jet printer, hereinafter simply referred to as a printer.

FIG. 1 is a schematic plan view of a printer PRT according to an embodiment of the invention.

The printer PRT shown in FIG. 1 is configured to perform printing while transporting a sheet-form recording medium M such as paper, a plastic sheet, or the like. The printer PRT includes a casing PB, an ink jet mechanism IJ that ejects an ink onto the recording medium M, an ink supply mechanism IS that supplies the ink to the ink jet mechanism IJ, a transport mechanism CV that transports the recording medium M, a maintenance mechanism MN that provides a maintenance operation for the ink jet mechanism IJ, and a control unit CONT that controls the foregoing constituents.

For the purpose of the description an XYZ orthogonal coordinate system is introduced, on the basis of which the positional relationship between the constituents will be described. In this embodiment, the direction in which the recording medium M is transported (hereinafter, transport direction) will be defined as X-axis direction; a direction orthogonal to the X-axis on a plane along which the recording medium M is transported will be defined as Y-axis direction; and a direction perpendicular to a plane that includes both the X-axis and the Y-axis will be defined as Z-axis.

The casing PB is formed such that a longer side thereof extends in the Y-axis direction. The casing PB accommodates therein the ink jet mechanism IJ, the ink supply mechanism IS, the transport mechanism CV, the maintenance mechanism MN and the control unit CONT. A platen 13 is provided in the casing PB. The platen 13 is a support member that supports the recording medium M. The platen 13 is located at a central position of the casing PB in the X-axis direction. The platen 13 includes a flat surface 13*a* oriented in the +Z direction. The flat surface 13*a* serves as a supporting surface that supports the recording medium M.

The transport mechanism CV includes a transport roller and a motor that drives the transport roller (neither shown). The transport mechanism CV transports the recording medium M from the −X side of the casing PB into inside thereof, and delivers the recording medium M to outside of the casing PB from the +X side thereof. The transport mechanism CV transports the recording medium M such that the recording medium M passes over the platen 13 inside the casing PB. The transport mechanism CV is controlled by the control unit CONT so as to adjust the timing and distance of the transportation.

The ink jet mechanism IJ includes an ink jet head (liquid ejecting head) H that ejects the ink, and a head moving mechanism AC that supports and moves the ink jet head H. The ink jet head H ejects the ink onto the recording medium M brought to the platen 13. The ink jet head H includes an ejection surface Ha from which the ink is ejected. The ejection surface Ha is oriented in the Z-axis direction, so as to oppose the supporting surface of the platen 13.

The head moving mechanism AC includes a carriage CA. The ink jet head H is fixed to the carriage CA. The carriage CA is set so as to move along a guide shaft 8 installed in the longitudinal direction of the casing PB, i.e., the Y-axis direction. The ink jet head H and the carriage CA are located on the +Z side of the platen 13.

In addition to the carriage CA, the head moving mechanism AC includes a pulse motor 9, a drive pulley 10 driven so as to rotate by the pulse motor 9, a slave pulley 11 provided on the −Y side opposite the drive pulley 10 (+Y side) in the longitudinal direction of the casing PB, and a timing belt 12 wound between the drive pulley 10 and the slave pulley 11.

The carriage CA is connected to the timing belt 12. The carriage CA is caused to move in the Y-axis direction by the rotation of the timing belt 12. The carriage CA is guided along the guide shaft 8, when moving in the Y-axis direction.

The maintenance mechanism MN is located at a home position of the ink jet head H. The home position is located in a region separated from the region where printing is performed on the recording medium M. In this embodiment, the home position is located on the +Y side of the platen 13. The home position is the position where the ink jet head H stands by when the power for the printer PRT is off and when printing has not been performed for a predetermined period of time.

The maintenance mechanism MN includes a capping mechanism CP that covers the ejection surface Ha of the ink jet head H and a wiping mechanism WP that wipes the ejection surface Ha. A suction unit SC, for example a suction pump, is connected to the capping mechanism CP. The capping mechanism CP is configured so as to suck the ink from the ink jet head H with the suction unit SC, while covering the ejection surface Ha.

The ink supply mechanism IS serves to supply the ink to the ink jet head H. The ink supply mechanism IS includes a plurality of ink cartridges (liquid reservoir) CTR. The printer PRT according to this embodiment, the ink cartridge CTR is not mounted on the carriage CA (off-carriage type), unlike the ink jet head H.

Figure 2:
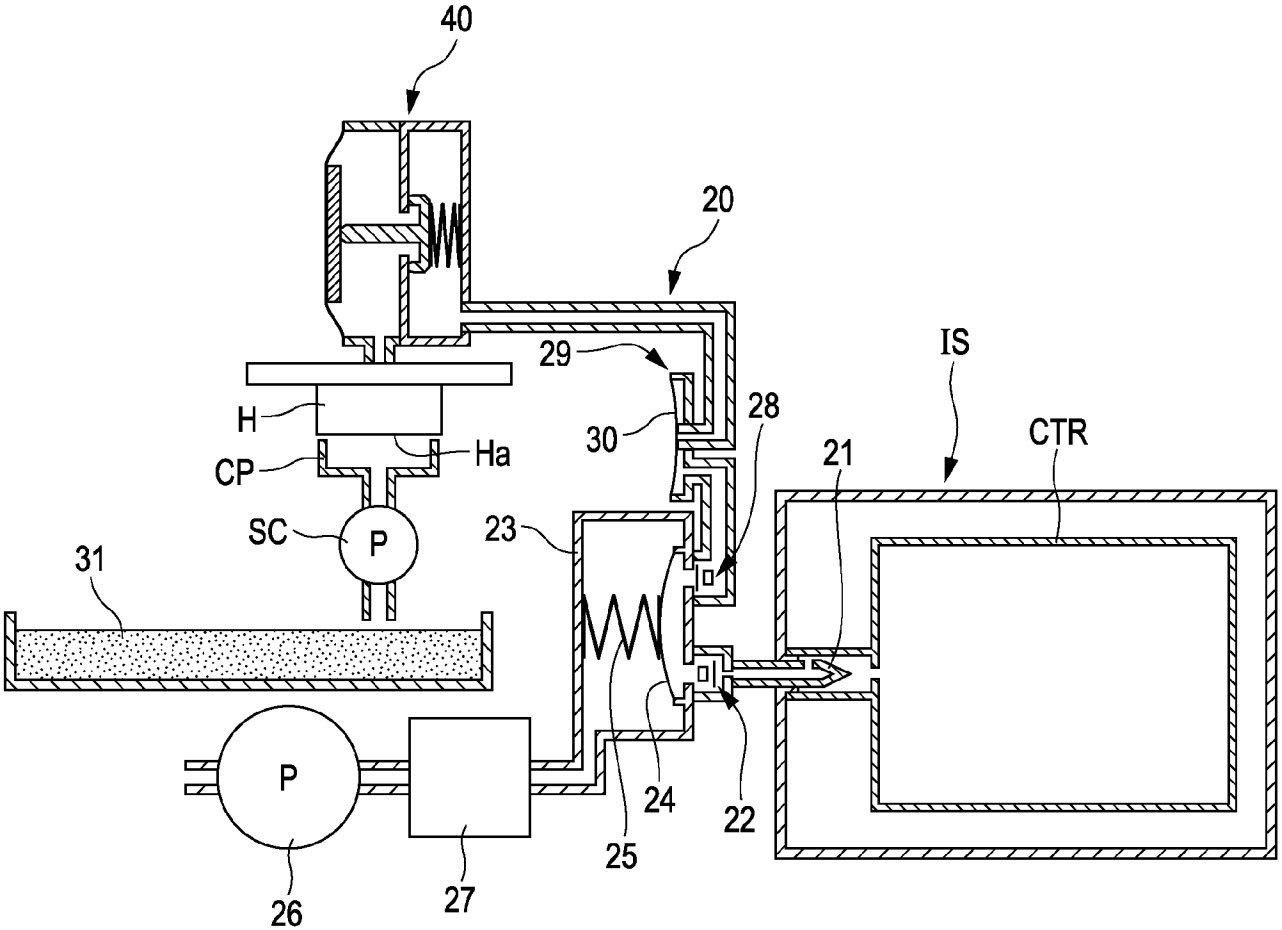
FIG. 2 is a schematic diagram showing a general configuration of an ink flow path of an ink supply mechanism according to the embodiment.

FIG. 2 is a schematic diagram showing a general configuration of an ink flow path 20 of the ink supply mechanism IS according to this embodiment.

The ink supply mechanism IS includes an ink flow path (liquid flow path) 20 connecting between the ink cartridge CTR and the ink jet head H. An ink supply needle 21 is provided at an end portion of the ink flow path 20. The ink supply needle 21 is inserted into the ink cartridge CTR, so as to allow communication between the inside of the ink cartridge CTR and the ink flow path 20.

The ink introduced into the ink flow path 20 through the ink supply needle 21 enters a depressurization chamber 23 trough a check valve 22. The depressurization chamber 23 includes a diaphragm 24 to be displaced in accordance with an internal pressure so as to change the capacity, and a compression spring 25 that biases the diaphragm 24. In addition, a depressurizing pump 26 that depressurizes the inside of the depressurization chamber 23, and an air-intake valve 27 that cancels the depressurization are connected to the depressurization chamber 23.

Upon activating the depressurizing pump 26 with the air-intake valve 27 closed, the diaphragm 24 expands against the biasing force of the compression spring 25, so that the ink can flow into the depressurization chamber 23 from the ink cartridge CTR. Upon stopping the depressurizing pump 26 and opening the air-intake valve 27, the diaphragm 24 is made to contract by the biasing force of the compression spring 25, so that the ink can flow out of the depressurization chamber 23 through the check valve 28, at a predetermined pressure.

The ink that has flowed out of the depressurization chamber 23 is supplied to the ink jet head H through a choke valve 29 and a self-closing valve (pressure control unit) 40. The choke valve 29 includes a diaphragm 30 that closes the ink flow path 20 when the suction unit SC of the capping mechanism CP depressurizes the side of the ink jet head H exceeding a predetermined pressure. The suction unit SC can perform so-called choke cleaning, utilizing the choke valve 29.

The choke cleaning is a process including driving the suction unit SC so as to depressurize the ink flow path 20 on the side of the ink jet head H, further depressurizing the closed flow path upstream of the choke valve 29 even after the choke valve 29 is closed, and introducing the pressurized ink to the choke valve 29 from the depressurization chamber 23 in the depressurized state, so as to allow the ink to flow with great force into the depressurized ink flow path 20 on the side of the ink jet head H upon opening the flow path thus far closed, to thereby forcibly discharge bubbles and thickened ink mixed in the self-closing valve 40 and the ink jet head H. The ink forcibly sucked and discharged from the ink jet head H is absorbed in an ink waste absorber 31.

Figure 3:
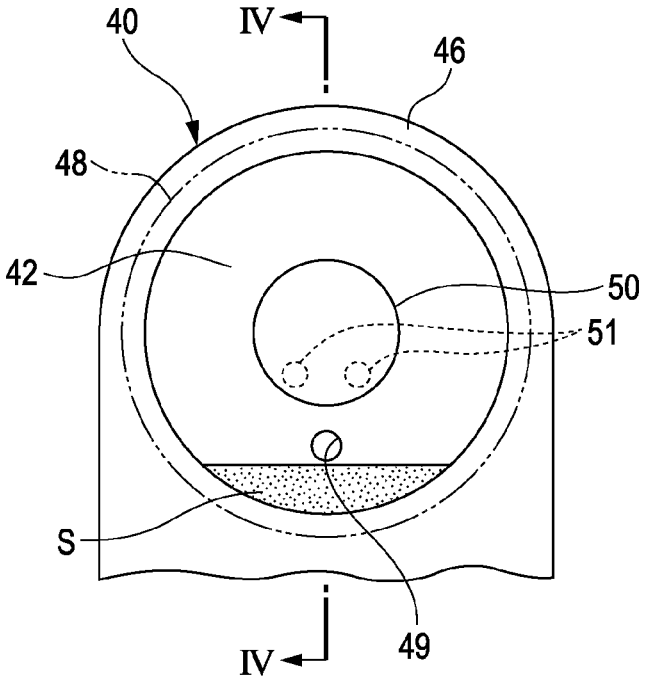
FIG. 3 is a schematic side view of a self-closing valve according to the embodiment.
Figure 4:
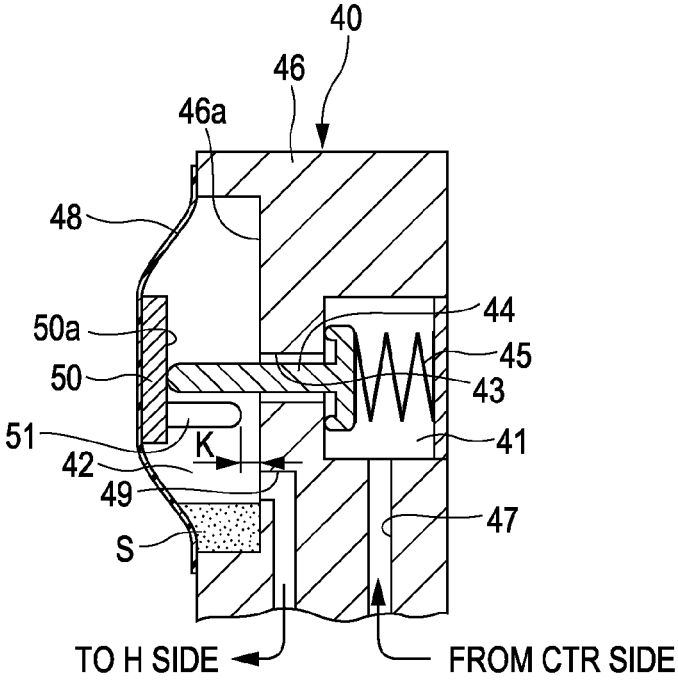
FIG. 4 is a cross-sectional view taken along a line IV-IV in FIG. 3.

FIG. 3 is a schematic side view of the self-closing valve 40 according to this embodiment. FIG. 4 is a cross-sectional view taken along a line IV-IV in FIG. 3. The up and down direction based on the orientation of FIGS. 3 and 4 corresponds to the vertical direction (direction of gravity), and a code S schematically represents deposited ingredients such as pigments contained in the ink.

The self-closing valve 40 is provided in the ink flow path 20 connecting between the ink cartridge CTR and the ink jet head H, and serves as a pressure-regulating valve so as to store the ink and open and close the ink flow path 20 in accordance with the pressure on the side of the ink jet head H. The self-closing valve 40 is mounted on the carriage CA together with the ink jet head H (see FIG. 1).

The self-closing valve 40 includes, as shown in FIG. 4, an on-off valve 44 that opens and closes a communication hole 43 that allows communication between a first ink chamber (liquid introduction unit) 41 located on the side of the ink cartridge CTR and a second ink chamber (liquid chamber) 42 located on the side of the ink jet head H. The on-off valve 44 can be displaced between a position for closing the communication hole 43 and a position for opening the communication hole 43 against a biasing force of a switching pressure control spring 45, in accordance with a pressure in the second ink chamber 42.

The on-off valve 44 according to this embodiment is configured to open the communication hole 43 with the on-off pressure control spring 45, in the case where the pressure in the second ink chamber 42 reaches −100 Pa from the atmospheric pressure. Assuming that the overall displacement stroke of the on-off valve 44 is 1 mm to 2 mm for example, the on-off valve 44 is configured to be displaced over a stroke of 0.03 mm to 0.05 mm in the above-mentioned case. Here, the on-off valve 44 is configured to be displaced over a range larger than 0.03 mm to 0.05 mm, for example over the entire stroke of 1 mm to 2 mm, when the suction unit SC sucks the ink at −80 kPa from the atmospheric pressure to perform the cleaning operation.

The first ink chamber 41 is defined by a base member 46, and includes an ink inlet (liquid inlet) 47 communicating with the side of the ink cartridge CTR. The ink inlet 47 is connected to the choke valve 29 via the ink flow path 20 (see FIG. 2). The first ink chamber 41 has a predetermined capacity so as to store the ink introduced through the ink inlet 47. Also, an end portion of the on-off valve 44 capable of closing the communication hole 43 and the on-off pressure control spring 45 are accommodated inside the first ink chamber 41.

The second ink chamber 42 is defined by the base member 46 and a diaphragm 48, and includes an ink outlet (liquid outlet) 49 communicating with the side of the ink jet head H. The ink outlet 49 is connected to the ink jet head H via the ink flow path 20. The second ink chamber 42 has a variable capacity so as to store the ink introduced through the communication hole 43. Also, the other end portion of the on-off valve 44 and a pressure-receiving plate (movable member) 50 are accommodated inside the second ink chamber 42.

The diaphragm 48 is composed of a multilayered flexible resin film. The diaphragm 48 is attached to a lateral face of the base member 46 with a predetermined play. The diaphragm 48 is displaced in accordance with the pressure in the second ink chamber 42, so as to change the volume of the second ink chamber 42.

The pressure-receiving plate 50 is hot-melt bonded to a resin layer such as a polypropylene layer to the surface of the diaphragm 48 oriented to the second ink chamber 42, so as to be displaced together with the diaphragm 48 in an interlocked manner. The pressure-receiving plate 50 includes an opposing surface 50*a* oriented to the communication hole 43. The other end portion of the on-off valve 44 inserted through the communication hole 43 is disposed in contact with the opposing surface 50*a*. The tip portion of the on-off valve 44 is chamfered into a roundish shape.

The pressure-receiving plate 50 is of a circular disk shape (see FIG. 3), and the other end portion of the on-off valve 44 is in contact with the central position (position of center of gravity) of the opposing surface 50*a* which is also circular. The on-off pressure control spring 45 is exerting its biasing force on the pressure-receiving plate 50 in a direction to expand the diaphragm 48. When the ink is consumed by the ink jet head H and the pressure in the second ink chamber 42 decreases so as to contract the diaphragm 48, the pressure-receiving plate 50 pushes back the on-off valve 44 against the biasing force of the on-off pressure control spring 45, so as to open the communication hole 43.

The pressure-receiving plate 50 includes a pair of displacement members 51 that change the posture of the opposing surface 50*a* in accordance with the pressure of the second ink chamber 42. The displacement members 51 are formed so as to project in a direction in which the diaphragm unit 48 is displaced (left and right direction in FIG. 4), and located at positions different from the center of gravity of the pressure-receiving plate 50 (see FIG. 3). In this embodiment, the displacement members 51 are erected toward a surface 46*a* of the base member 46 where the communication hole 43 is located, from positions on the opposing surface 50*a* lower than the center of gravity thereof. The tip portion of the displacement member 51 is chamfered into a roundish shape.

The tip portion of the displacement member 51 is spaced from the surface 46*a* where the communication hole 43 is located, by a clearance K, except for while the cleaning is performed to forcibly suck the ink from the ink jet head H, in other words during a normal operation of ejecting the ink from the ink jet head H onto the recording medium M to thereby perform printing. More specifically, the clearance K is larger than the displacement stroke (0.03 mm to 0.05 mm) realized by the on-off valve 44 when the pressure in the second ink chamber 42 drops to −100 Pa or lower from the atmospheric pressure.

The opposing surface 50*a* is disposed, as shown in FIG. 4, so as to remain in the first posture of straightly opposing the communication hole 43 (in other words, orthogonal to an extension of the axial line of the communication hole 43) during the normal operation, i.e., except for during the cleaning operation. Such a configuration allows the opposing surface 50*a* to stably remain in the first posture during the normal operation of ejecting the ink from the ink jet head H, thereby preventing the pressure control function from being affected, for example from suffering fluctuation of the on-off pressure.

The opposing surface 50*a* in the first posture causes the ink introduced from the first ink chamber 41 into the second ink chamber 42 through the communication hole 43 to radially flow along the opposing surface 50*a*. Here, the ink outlet 49 is located at a position upper than the bottom portion of the second ink chamber 42. Such a configuration restricts the deposited ingredients S accumulated on the bottom portion of the ink chamber 42 from being supplied to the side of the ink jet head H through the ink outlet 49, during the normal operation in which the ink is ejected from the ink jet head H.

Figure 5:
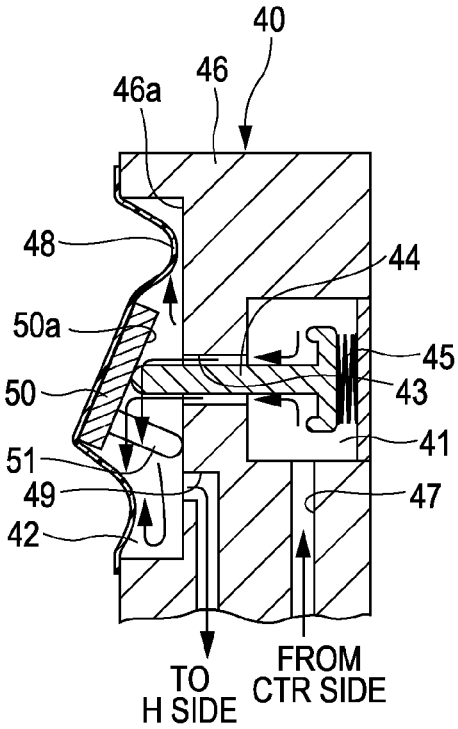
FIG. 5 is a cross-sectional view showing a posture of an opposing surface in a cleaning operation according to the embodiment.

FIG. 5 is a cross-sectional view showing the posture of the opposing surface 50*a* during the cleaning operation according to the embodiment.

The displacement members 51 displace, as shown in FIG. 5, the opposing surface 50*a* to the second posture in which the opposing surface 50*a* is tilted with respect to the communication hole 43 in an angle different from the first posture, when the pressure reaches a predetermined threshold by the sucking operation of the suction unit SC in the cleaning operation. The threshold may be set in a range −100 Pa or lower and −80 kPa or higher, from the atmospheric pressure.

The displacement member 51 is formed so as to project in a direction in which the diaphragm unit 48 is displaced, and located at a position different from the center of gravity of the pressure-receiving plate 50. Accordingly, when the diaphragm unit 48 is displaced such that the tip portion of the displacement member 51 is brought into contact with the surface 46*a* where the communication hole 43 is located, the displacement member 51 applies a momentum to the pressure-receiving plate 50 about the position of the center of gravity thereof, so that the opposing surface 50*a* is tilted. In other words, the displacement members 51 are activated by contraction of the diaphragm unit 48 caused during the cleaning operation, so as to tilt the opposing surface 50*a* of the pressure-receiving plate 50 caused to move in response to the contraction. Thus, the displacement members 51 regulate the flow of the ink introduced through the communication hole 43 with the tilting action of the opposing surface 50*a* so as to form a stirring flow to thereby stir up the deposited ingredients S accumulated on the bottom portion.

The opposing surface 50*a* is disposed so as to remain in the second posture during the cleaning operation, such that a lower portion thereof is positioned farther away from the surface 46*a* where the communication hole 43 is located than an upper portion opposite the lower portion across the communication hole 43 (in other words, the opposing surface 50*a* intersects the extension of the axial line of the communication hole 43). Accordingly, when the opposing surface 50*a* is in the second posture, the ink introduced from the first ink chamber 41 into the second ink chamber 42 through the communication hole 43 collides against the opposing surface 50*a* so as to be conducted toward the bottom portion, and stirs up the deposited ingredients S accumulated on the bottom portion. Further, when the opposing surface 50*a* is in the second posture, the upper portion of the opposing surface 50*a*, which is positioned closer to the surface 46*a* where the communication hole 43 is located, creates greater resistance against the ink flow compared with the lower portion of the opposing surface 50*a*, positioned farther away from the surface 46*a* where the communication hole 43 is located. Therefore, the majority of the ink flow can be conducted toward the bottom portion, so as to effectively stir up the deposited ingredients S accumulated on the bottom portion.

In addition, when the opposing surface 50*a* is tilted such that the lower portion thereof is positioned farther away from the surface 46*a* where the communication hole 43 is located than the upper portion opposite the lower portion across the communication hole 43, an upper portion of the diaphragm unit 48 is facilitated to contract compared with a lower portion thereof. Accordingly, in the case where bubbles are present in a top portion of the second ink chamber 42, the bubbles are squeezed out by the contraction of the upper portion of the diaphragm unit 48, and induced to be outwardly discharged together with the ink flow. Further, the ink outlet 49 is located at a position outside a region opposing the pressure-receiving plate 50 when viewed in a direction in which the diaphragm unit 48 is displaced (see FIG. 3). Such a configuration facilitates the bubbles to be discharged outward through the ink outlet 49, because the diaphragm unit 48 contracts outside the region opposing the pressure-receiving plate 50.

The deposited ingredients S that have been stirred up flow out through the ink outlet 49, to be absorbed by the waste absorber 31 after passing through the ink jet head H and the suction unit SC. Stirring up the deposited ingredients S as above allows the deposited ingredients S to be efficiently removed, without the need to waste the entire ink in the second ink chamber 42 as in the conventional cleaning operation. This leads to reduced amount of the ink waste from the cleaning operation.

Thus, the printer PRT according to this embodiment includes the self-closing valve 40 provided in the ink flow path 20 connecting between the ink cartridge CTR and the ink jet head H, and configured to store the ink and to open and close the ink flow path 20 to thereby control the pressure thereof. The self-closing valve 40 includes the first ink chamber 41 including the ink inlet 47 communicating with the side of the ink cartridge CTR; the second ink chamber 42 including the ink outlet 49 communicating with the side of the ink jet head H and the diaphragm 48 to be displaced in accordance with the pressure so as to change the volume of the second ink chamber 42; the communication hole 43 that allows communication between the first ink chamber 41 and the second ink chamber 42; the pressure-receiving plate 50 movable in response to the displacement of the diaphragm unit 48 and including the opposing surface 50*a* disposed on the side of the second ink chamber 42 so as to oppose the communication hole 43, the pressure-receiving plate 50 being movable in response to the displacement of the diaphragm unit 48; and the displacement members 51 that displace, in accordance with the pressure of the second ink chamber 42, the opposing surface 50*a* between the first posture of opposing the communication hole 43 and the second posture in which the opposing surface 50*a* is tilted with respect to the communication hole 43 in an angle different from the first posture. With the foregoing configuration, the opposing surface 50*a* of the pressure-receiving plate 50, disposed so as to move in response to the displacement of the diaphragm unit 48 of the self-closing valve 40, is displaced between the first posture and the second posture in accordance with the pressure on the side of the ink jet head H. Accordingly, the flow of the ink introduced from the first ink chamber 41 into the second ink chamber 42 through the communication hole 43 can be changed by the tilting action of the opposing surface 50*a*, so that such change in the ink flow stirs up the deposited ingredients of the liquid.

Consequently, the printer PRT according to this embodiment allows the ingredients S of the ink deposited in the self-closing valve 40 to be efficiently stirred up without employing a complicated mechanism.

Although the exemplary embodiment of the invention has been described as above, it is to be understood that the invention is in no way limited to the foregoing embodiment. The aforementioned shapes and combinations of the constituents are only exemplary, and may be modified in various manners within the scope of the invention, in accordance with designing requirements and so forth.

Figure 6:
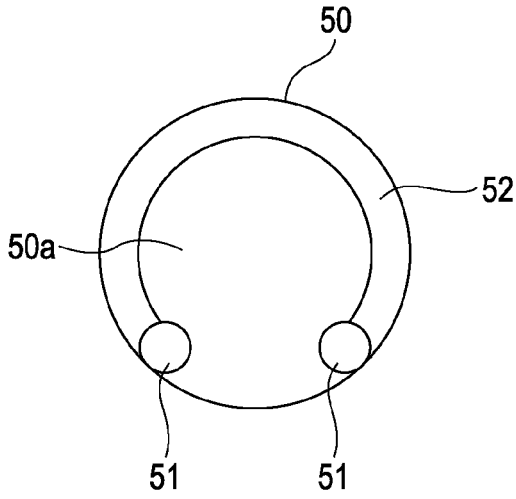
FIG. 6 is a front view of a pressure-receiving plate according to a variation of the embodiment of the invention.
Figure 7:
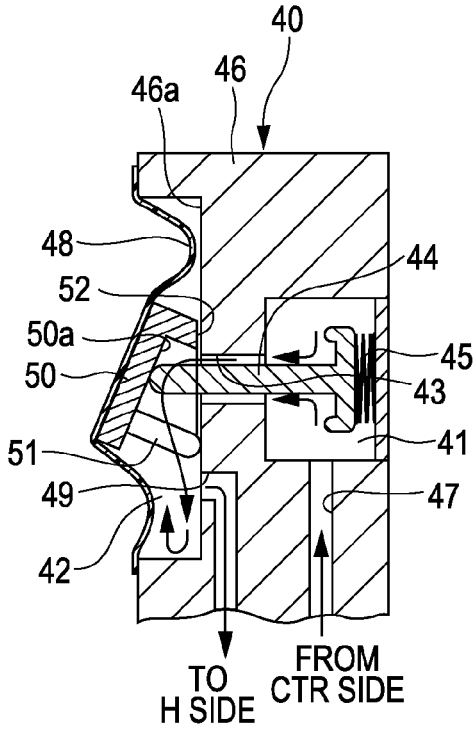
FIG. 7 is a cross-sectional view for explaining the operation of the pressure-receiving plate according to the variation of the embodiment.

For example, as shown in FIGS. 6 and 7, the displacement member 51 may include an annular portion 52, formed so as to project from the opposing surface 50*a* and to annularly block all directions other than the direction in which the opposing surface 50*a* is tilted in the second posture. In other words, the annular portion 52 is formed in a ring shape that surrounds the communication hole 43 when the opposing surface 50*a* is in the second posture as shown in FIG. 7, with an opening provided at a lower portion corresponding to the lower portion of the opposing surface 50*a*. Such a configuration restricts the ink that has been introduced through the communication hole 43 and has collided against the opposing surface 50*a* from flowing in directions other than the direction in which the opposing surface 50*a* is tilted, thereby causing the ink to flow with greater force in the direction in which the opposing surface 50*a* is tilted and thus more efficiently stirring up the deposited ingredients S of the ink.

Although the displacement members 51 are provided on the pressure-receiving plate 50 in the foregoing embodiment, the displacement members 51 may be provided on the base member 46. However, since the annular portion 52 is prone to detain or collect bubbles, in the case where the annular portion 52 is formed with the displacement members 51 it is preferable to provide the displacement members 51 on the pressure-receiving plate 50 which moves in response to the displacement of the diaphragm unit 48, because the tilting action of the opposing surface 50*a* causes the annular portion 52 to tilt in an interlocked manner, thereby facilitating the bubbles to be discharged.

Although the opposing surface 50*a* is tilted so as to downwardly conduct the ink flow in the foregoing embodiment, the deposited ingredients S can be stirred up provided that the ink flow can be conducted in a direction different from the normal flow direction during the cleaning operation. Therefore, for example the ink flow may be conducted upward so as to facilitate the bubbles to be discharged.

Further, although the ink outlet 49 is located vertically below the communication hole 43 (6 o'clock direction in FIG. 3) in the foregoing embodiment, the ink outlet 49 may be located at different positions other than close to the bottom portion of the second ink chamber 42, for example in 4 o'clock direction from the communication hole 43.

Further, although the liquid ejecting apparatus is exemplified by the printer PRT in the foregoing embodiment, the invention may be applied to different apparatuses such as a copier and a facsimile machine.

Still further, the liquid ejecting apparatus may be configured to eject or dispense a liquid other than the ink. The invention may be applied to various liquid ejecting apparatuses having a liquid ejecting head that ejects or dispenses a minute amount of liquid droplet. Here, the term "liquid droplet" refers to the state of the liquid dispensed from the liquid ejecting apparatus, and examples of the liquid droplet include a droplet having a particle shape, a droplet having a teardrop shape, and a droplet having a trailing tail shape. The liquid herein referred to includes those materials that can be ejected by the liquid ejecting apparatus. For example, materials in a liquid phase may be employed such as a liquid having a high or low viscosity, a sol, a gel water, an inorganic solvent, an organic solvent, a solution, a liquid resin, a liquid metal (molten metal liquid), and also a solvent in which particles of a functional material composed of a solid substance, such as a pigment or metal particle, are dissolved, dispersed or mixed may be employed, in addition to the materials in the liquid phase. The liquid can be typically exemplified by the ink referred to in the foregoing embodiment, and a liquid crystal. Here, the ink includes a general water-based ink, oil-based ink, and a liquid composition such as a gel ink and a hot-melt ink.

What is claimed is:

1. A liquid ejecting apparatus comprising a pressure control unit provided in a liquid flow path connecting between a liquid reservoir and a liquid ejecting head, and configured to store the liquid and control a pressure thereof, wherein the pressure control unit includes:

a liquid introduction unit having a liquid inlet communicating with the liquid reservoir;

a liquid chamber including a liquid outlet communicating with the side of the liquid ejecting head and a diaphragm unit to be displaced in accordance with a pressure;

a communication hole that allows communication between the liquid introduction unit and the liquid chamber; and a movable member including an opposing surface disposed on the side of the liquid chamber so as to oppose the communication hole, the movable member being disposed so as to move in response to the displacement of the diaphragm unit; and a displacement member that displaces, in accordance with a pressure of the liquid chamber, the opposing surface between a first posture of opposing the communication hole and a second posture in which the opposing surface is tilted with respect to the communication hole in an angle different from the first posture.

2. The liquid ejecting apparatus according to claim 1, further comprising a suction unit that sucks the liquid from the liquid ejecting head, wherein the opposing surface is displaced to the second posture when the pressure reaches a predetermined level by a sucking operation of the suction unit.

3. The liquid ejecting apparatus according to claim 1, wherein the displacement member is formed so as to project in a direction in which the diaphragm unit is displaced, and located at a position different from the center of gravity of the movable member.

4. The liquid ejecting apparatus according to claim 1, wherein the opposing surface is disposed so as to be tilted in the second posture such that a lower portion thereof is positioned farther away from a surface where the communication hole is located than an upper portion of the opposing surface opposite the lower portion across the communication hole.

5. The liquid ejecting apparatus according to claim 1, wherein the displacement member includes an annular portion projecting from the opposing surface so as to block all directions other than a direction in which the opposing surface is tilted in the second posture.

6. The liquid ejecting apparatus according to claim 1, wherein the displacement member is provided on the movable member.

7. The liquid ejecting apparatus according to claim 1, wherein the liquid outlet is located at a position upper than a bottom portion of the liquid chamber.

8. The liquid ejecting apparatus according to claim 1, wherein the liquid outlet is located at a position outside a region opposing the movable member when viewed in a direction in which the diaphragm unit is displaced.

* * * * *